US011793306B2

(12) United States Patent
Chen et al.

(10) Patent No.: US 11,793,306 B2
(45) Date of Patent: Oct. 24, 2023

(54) FOLDABLE TABLE

(71) Applicant: Te-Lung Chen, Tainan (TW)

(72) Inventors: Te-Lung Chen, Tainan (TW); Pin-Yi Chen, Tainan (TW); Pin-Han Chen, Tainan (TW)

(73) Assignee: Te-Lung Chen, Tainan (TW)

( * ) Notice: Subject to any disclaimer, the term of this patent is extended or adjusted under 35 U.S.C. 154(b) by 0 days.

(21) Appl. No.: 17/684,754

(22) Filed: Mar. 2, 2022

(65) Prior Publication Data

US 2023/0276936 A1 Sep. 7, 2023

(51) Int. Cl.

| | |
|---|---|
| ***A47B 9/20*** | (2006.01) |
| ***A47B 9/04*** | (2006.01) |
| ***A47B 3/08*** | (2006.01) |

(52) U.S. Cl.

CPC ..... *A47B 9/20* (2013.01); *A47B 3/0803* (2013.01); *A47B 9/04* (2013.01)

(58) Field of Classification Search

CPC ..... A47B 9/20; A47B 9/3808; A47B 9/0815; A47B 9/0818; A47B 9/0809; A47B 9/091; A47B 2003/0821; A47B 2003/0824; A47B 2003/0827

USPC ..... 108/147.19, 115, 116, 129, 130, 131, 108/132, 133

See application file for complete search history.

(56) References Cited

U.S. PATENT DOCUMENTS

| | | | | |
|---|---|---|---|---|
| 3,141,645 | A * | 7/1964 | Hayden | A47B 3/0812 248/188 |
| 5,660,121 | A * | 8/1997 | Botts | E04H 3/28 108/123 |
| 6,044,775 | A * | 4/2000 | Lashlee | A47B 3/0818 248/188 |
| 6,454,357 | B1 * | 9/2002 | Foulger | A47C 16/025 108/131 |
| 7,757,617 | B2 * | 7/2010 | Larcom | A47B 3/0916 108/174 |
| 8,267,019 | B2 * | 9/2012 | Chen | A47B 9/14 108/169 |
| 11,166,545 | B1 * | 11/2021 | Chen | A47B 3/0809 |
| 2002/0152934 | A1 * | 10/2002 | Haney | A47B 13/003 108/130 |
| 2006/0021553 | A1 * | 2/2006 | Pleiman | A47B 3/0815 108/133 |
| 2006/0260516 | A1 * | 11/2006 | Chow | A61G 13/105 108/14 |
| 2008/0216719 | A1 * | 9/2008 | Larcom | A47B 3/0916 108/132 |

(Continued)

*Primary Examiner* — Jose V Chen

(74) *Attorney, Agent, or Firm* — MUNCY, GEISSLER, OLDS & LOWE, P.C.

(57) ABSTRACT

A foldable table includes a top plate, two leg units, and a telescopic support unit. Each leg unit includes two legs connected to and pivotable relative to the top plate. The telescopic support unit includes two support members, a first telescopic subunit, and a lock subunit. The support members are respectively mounted on the leg units. The first telescopic subunit is connected between the support members, and has an inner tube and an outer tube that is sleeved on and is slidable along the inner tube. The lock subunit is operable between a lock state and an unlock state for locking or unlocking sliding movement between the inner and the outer tubes.

10 Claims, 8 Drawing Sheets

(56) References Cited

U.S. PATENT DOCUMENTS

| | | | | |
|---|---|---|---|---|
| 2010/0018442 | A1* | 1/2010 | Knudsen | A47B 3/08 108/176 |
| 2020/0260863 | A1* | 8/2020 | Leng | B29C 65/562 |

* cited by examiner

FOLDABLE TABLE

FIELD

The disclosure relates to a table, and more particularly to a foldable table.

BACKGROUND

Conventional foldable tables generally include a top plate and legs that pivotably connected to the top plate. The legs are operable to be in a folded state for decreasing the storage space required for storing the table. Such conventional foldable tables are usually valued for their compactness when the legs are in the folded state.

SUMMARY

Therefore, an object of the disclosure is to provide a foldable table that can be easily operable to be folded and unfolded, and that provides more table surface area for putting things on.

According to the disclosure, a foldable table includes a top plate, two leg units, and a telescopic support unit. The leg units are spaced apart from each other in a longitudinal direction. Each of the leg units includes two legs that are connected to the top plate and that are pivotable relative to the top plate between an unfolded position, where free ends of the legs are distal from the top plate, and a folded position, where the free ends of the legs are proximate to the top plate. The telescopic support unit includes two support members, a first telescopic subunit, and a lock subunit. The support members are respectively mounted on the leg units and are spaced apart from the top plate. The first telescopic subunit is connected between the support members, and has an inner tube that has an inner space extending in the longitudinal direction, and an outer tube that is sleeved on and that is slidable along the inner tube. The lock subunit is mounted in the inner space of the inner tube, and is operable between a lock state, where the lock subunit extends through the inner tube and the outer tube in a radial direction which is perpendicular to the longitudinal direction, so that the legs are maintained in the unfolded position, and that relative sliding movement between the inner tube and the outer tube is not allowed, and an unlock state, where the lock subunit is entirely retracted into the inner space to thereby allow relative sliding movement between the inner tube and the outer tube.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
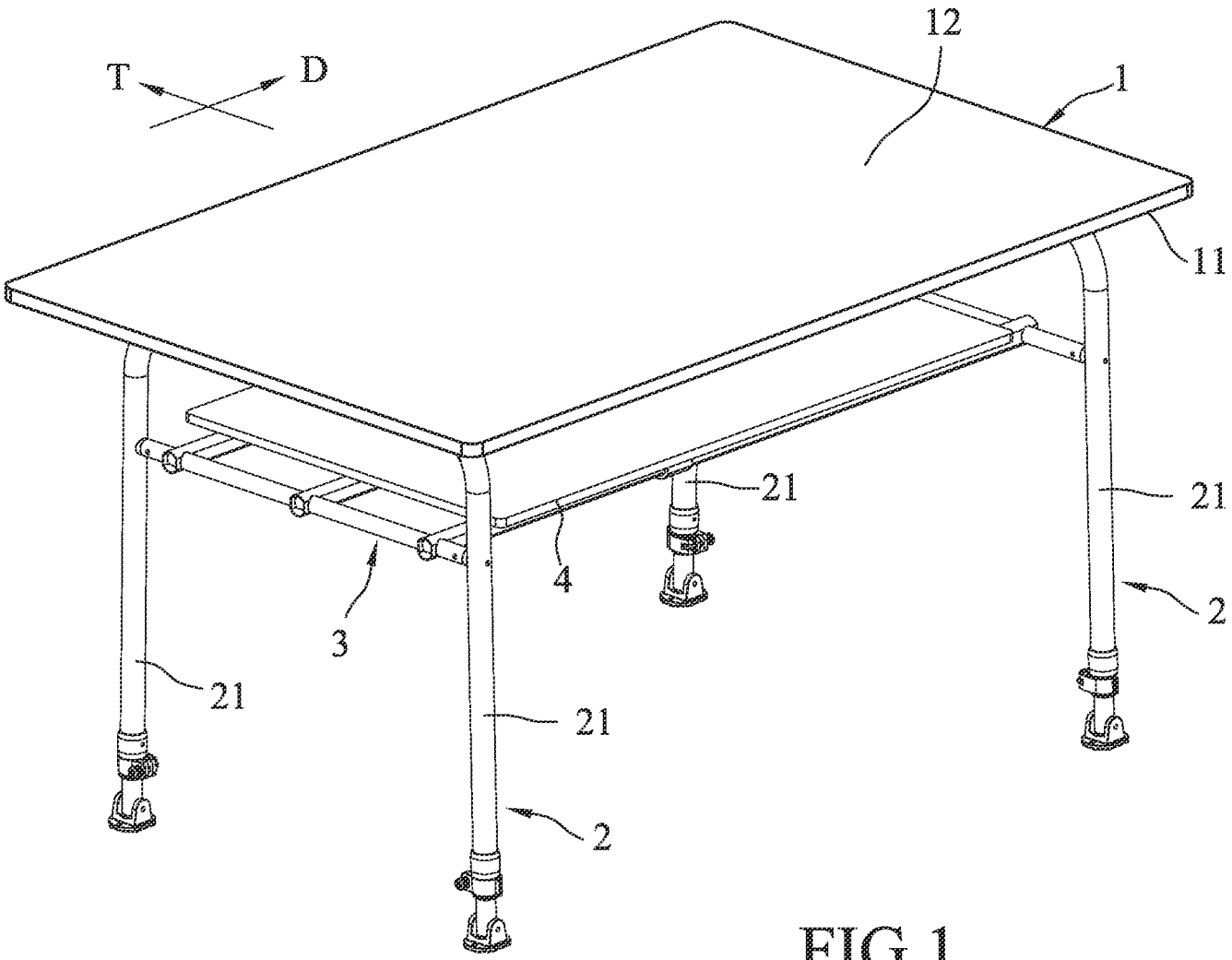
FIG. 1 is a perspective view illustrating a foldable table according to a first embodiment of the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
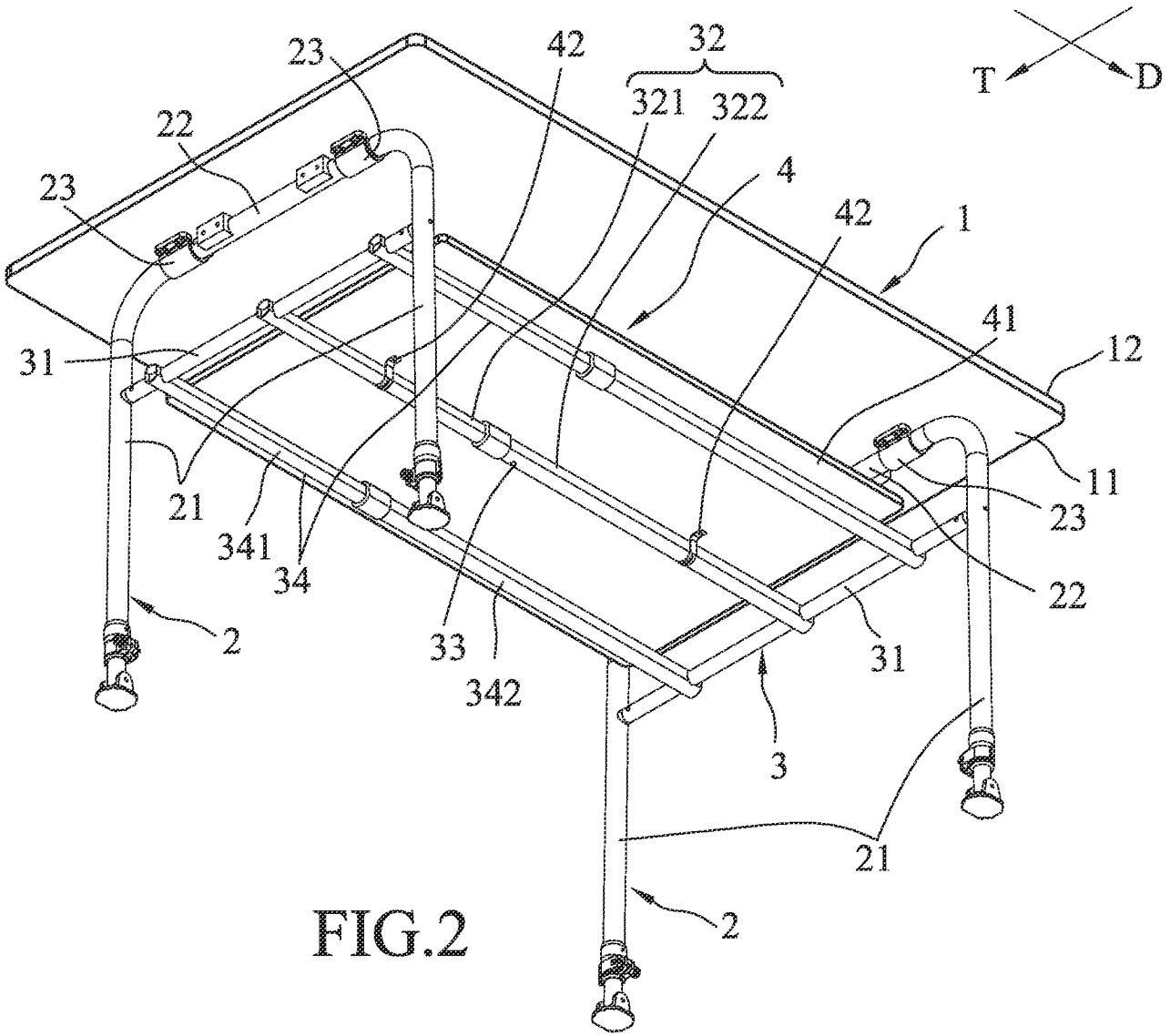
FIG. 2 is another perspective view of the first embodiment viewed from a different angle.
Figure 3:
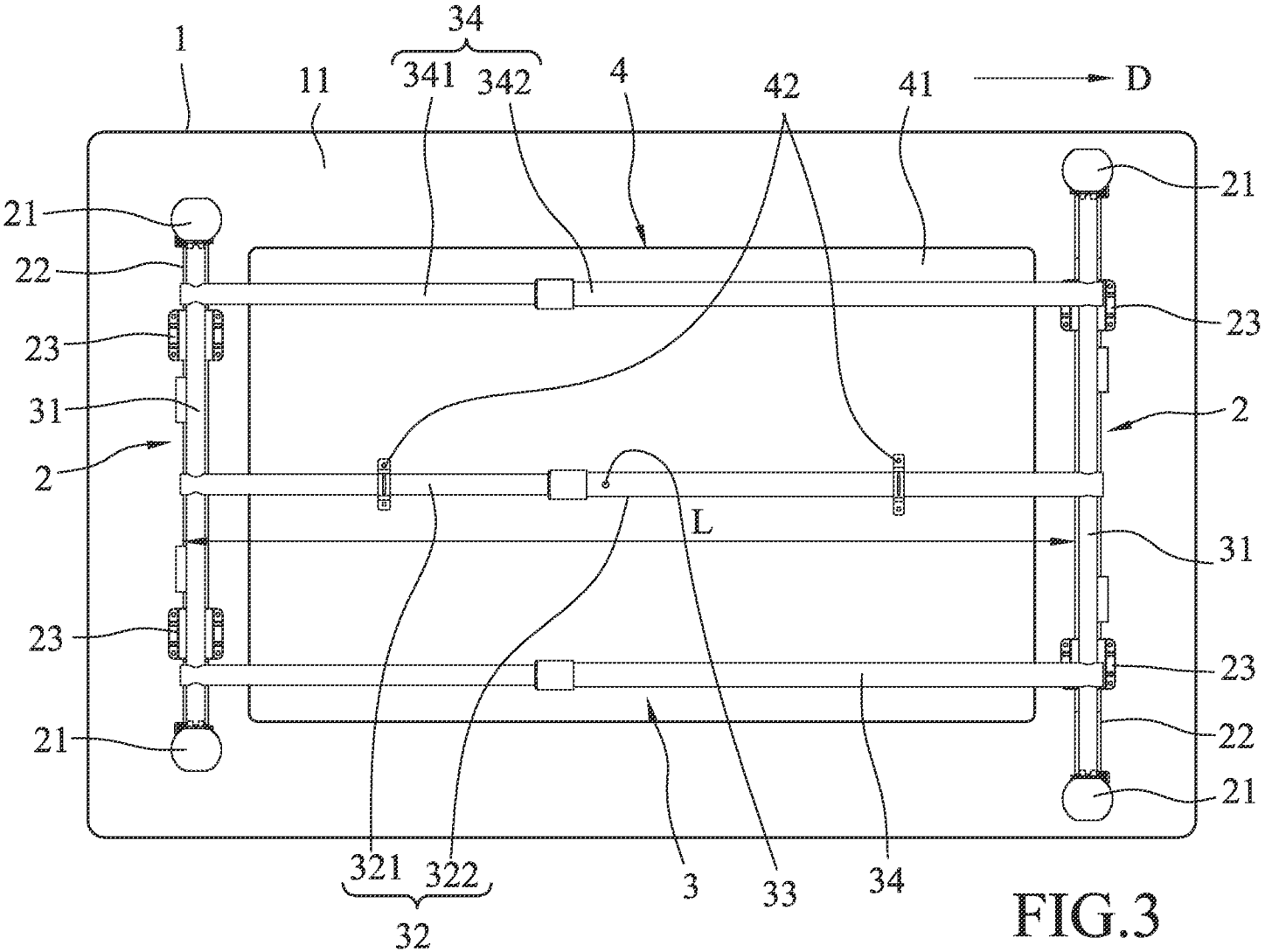
FIG. 3 is a bottom view of the first embodiment.

Referring to FIGS. 1 to 3, a foldable table according to a first embodiment of the disclosure is adapted to be disposed on a floor (not shown), and includes a top plate 1, two leg units 2, a telescopic support unit 3, and an auxiliary plate unit 4.

The top plate 1 is elongated in a longitudinal direction (D), and has a bottom surface 11 and a top surface 12 that is opposite to the bottom surface 11 and that is for putting things (not shown) thereon.

Figure 7:
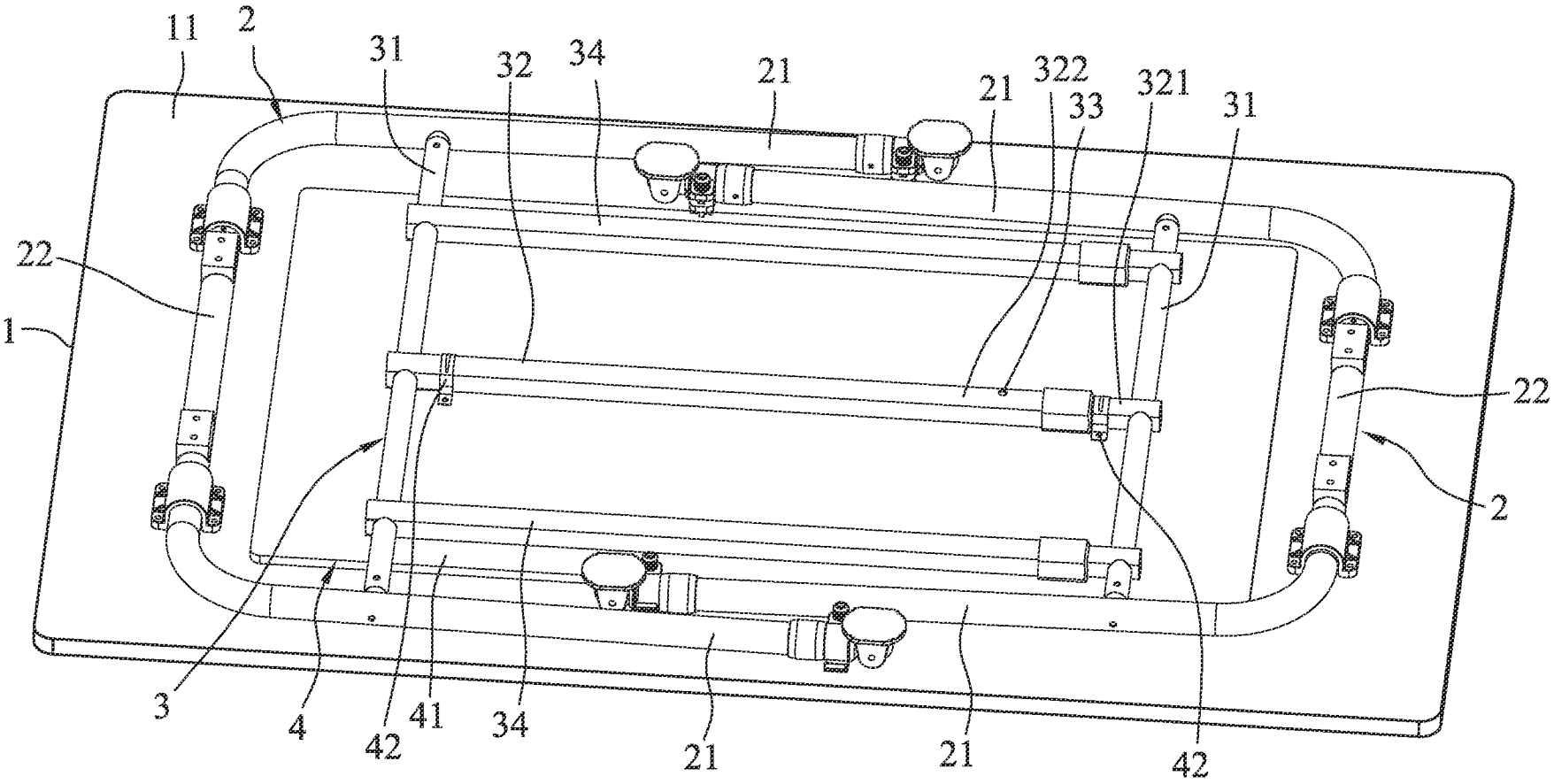
FIG. 7 is yet another perspective view of the first embodiment viewed from a different angle, in which legs of the foldable table are in a folded position.

The two leg units 2 are disposed under the top plate 1, and are spaced apart from each other in the longitudinal direction (D). In this embodiment, each of the leg units 2 includes two legs 21 that are spaced apart from each other in a transverse direction (T) perpendicular to the longitudinal direction (D), a connecting part 22 that interconnects top portions of the legs 21, and two bracket members 23 that are fixed to the bottom surface 11 of the top plate 1 and that cooperate with the top plate 1 to surround the connecting part 22, such that the connecting part 22 is capable of rotating relative to the bracket members 23 about an axis thereof, and such that the legs 21 are connected to the top plate 1 and are pivotable relative to the top plate 1 between an unfolded position, where free ends of the legs 21 are distal from the top plate 1, and a folded position, where the free ends of the legs 21 are proximate to the top plate 1 (as shown in FIG. 7).

In this embodiment, for each leg unit 2, the connecting part 22 is formed integrally with the legs 21 and cooperates with the legs 21 to form an inverted U-shaped structure, and the legs 21 are configured to be telescopic for adjusting the height of the foldable table when the legs 21 are in the unfolded state. Such telescopic configuration of table legs are well known by people skilled in the art, so that further description about the telescopic configuration of the legs 21 is omitted for the sake of brevity.

Figure 4:
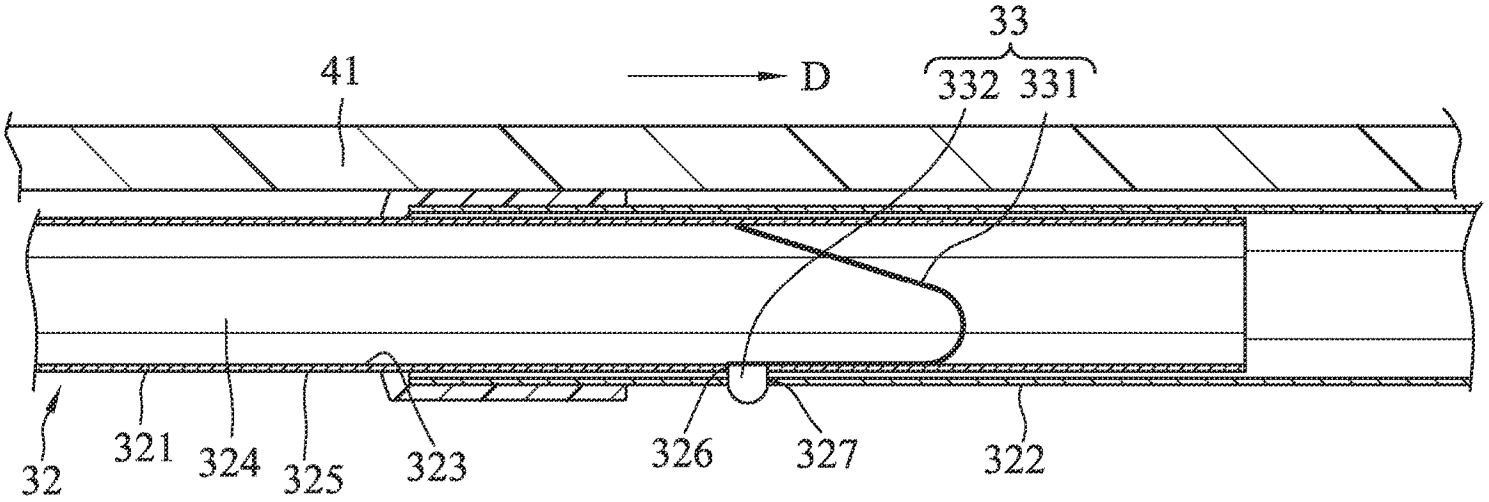
FIG. 4 is a fragmentary sectional view illustrating a first telescopic subunit, a lock subunit, and an auxiliary plate of the first embodiment, in which the lock subunit is in a lock state.

Referring to FIGS. 2 to 4, in this embodiment, the telescopic support unit 3 includes two support members 31 that are respectively mounted on the leg units 2 and that are spaced apart from the top plate 1, a first telescopic subunit 32 that is telescopically connected between the support members 31, a lock subunit 33, and two spaced-apart second telescopic subunits 34 that are telescopically and respectively connected between the support members 31.

Each support member 31 is configured as a rod, and is rotatably connected between the legs 21 of the respective one of the leg units 2.

The first telescopic subunit 32 has an inner tube 321 that is connected to one of the support members 31, and an outer tube 322 that is connected to the other one of the support members 31 and that is sleeved on and slidable along the inner tube 321, such that the first telescopic subunit 32 is capable of elongating and contracting between the support members 31.

The inner tube 321 has an inner surface 323 that defines an inner space 324 extending in the longitudinal direction (D), an outer surface 325 opposite to the inner surface 323, a first through hole 326 that extends through the inner and outer surfaces 324, 325 in a radial direction perpendicular to the longitudinal direction (D) and the transverse direction (T) and that spatially communicates with the inner space 324.

The outer tube 322 has a second through hole 327 that extends in the radial direction. Sliding movement of the outer tube 322 relative to the inner tube 321 will result in change of a distance between the first through hole 326 and the second through hole 327. When the second through hole 327 is registered with the first through hole 326 of the inner tube 321, the first telescopic subunit 32 has a maximum length (L) (see FIG. 3).

The lock subunit 33 is mounted in the inner space 324 of the inner tube 321, and that is operable between a lock state (shown in FIG. 4), where the lock subunit 33 extends through the inner and outer tubes 321, 322 in the radial direction, so that the legs 21 are maintained in the unfolded position, and that relative sliding movement between the inner and outer tubes 321, 322 is not allowed, and an unlock state (shown in FIG. 5), where the lock subunit 33 is entirely retracted into the inner space 324 to thereby allow relative sliding movement between the inner and outer tubes 321, 322.

As shown in FIG. 4, the lock subunit 33 has a resilient member 331 and a block member 332. The resilient member 331 is disposed in the inner tube 321, is configured as a V-shaped leaf spring, and has an end abutting against the inner surface 323 of the inner tube 321, and another end that is connected to the block member 332. The block member 332 retractably extends through the first and second through holes 326, 327 when the lock subunit 33 is in the lock state.

The two second telescopic subunits 34 are arranged in the transverse direction (T) on both sides of the first telescopic subunit 32, and are spaced apart from the first telescopic subunit 32 in the transverse direction (T). Specifically, each of the second telescopic subunits 34 includes an inner tube member 341 that extends in the longitudinal direction (D) and that is connected to one of the support members 31, and an outer tube member 342 that is connected to the other one of the support members 31, and that is sleeved on and slidable along the inner tube member 341, such that each second telescopic subunit 34 is capable of elongating and contracting between the support members 31.

It is noted that the number of the second telescopic subunits 34 may vary in other embodiments, and is not limited to the disclosure.

The auxiliary plate unit 4 includes an auxiliary plate 41 that is elongated in the longitudinal direction (D) and that is supported by the first and second telescopic subunits 32, 34, and two fixture members 42 that are spaced apart from each other in the longitudinal direction (D), that are fixed to a bottom surface of the auxiliary plate 41, and that cooperate with the auxiliary plate 41 to surround the first telescopic subunit 32 without interfering with sliding movement of the outer tube 322 relative to the inner tube 321.

It is noted that the number of the fixture members 42 may vary in other embodiments, and is not limited by the disclosure. For example, the auxiliary plate unit 4 can includes only one fixture member 42.

Figure 6:
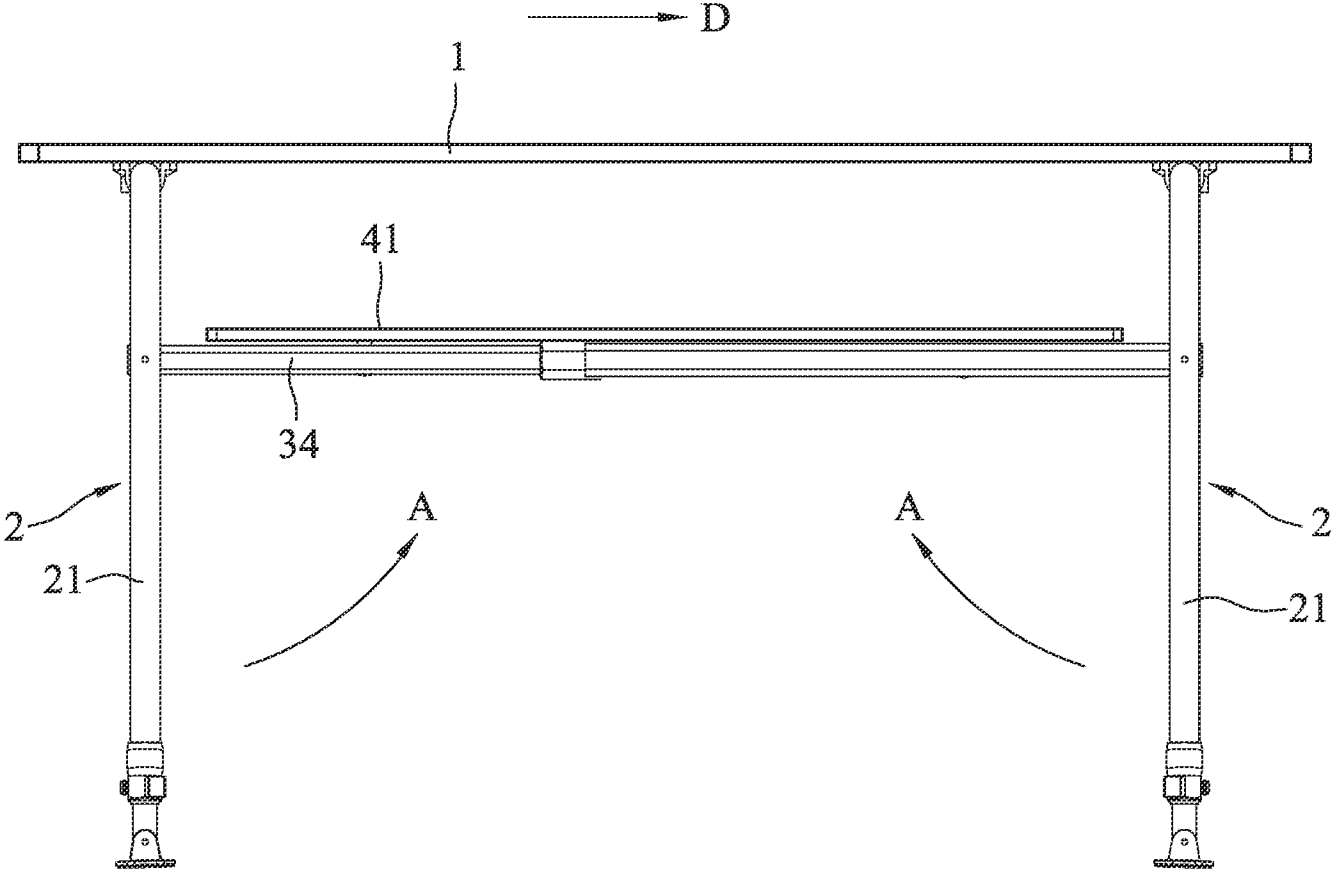
FIG. 6 is a side view of the first embodiment.

Referring to FIGS. 3, 4, and 6, when the legs 21 are in the unfolded position and the first telescopic subunit 32 has the maximum length (L), the first and second through holes 326, 327 are registered with each other, such that the block member 332, being biased by the resilient member 331 outwardly in the radial direction, extends through the first and second through holes 326, 327 and protrudes outwardly from the outer tube 322, thereby converting the lock subunit 33 to the lock state. At this time, the legs 21 are fixed into the unfolded position.

Figure 5:
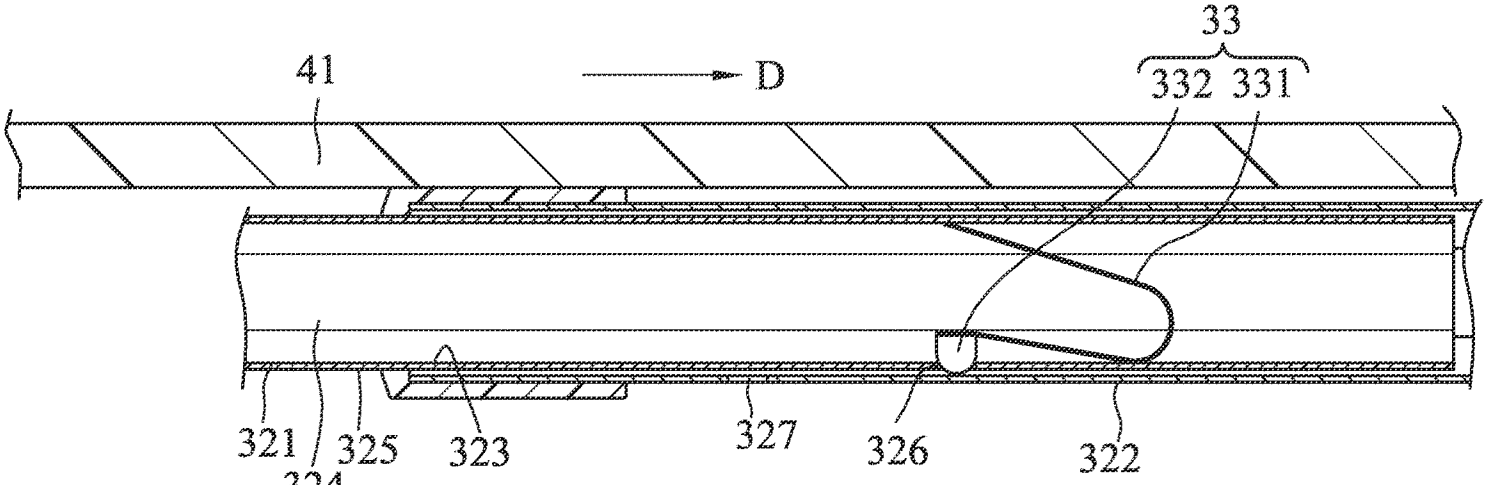
FIG. 5 is a view similar to FIG. 4 but showing that the lock subunit is in an unlock state.

Referring to FIGS. 5 to 7, to move the legs 21 from the unfolded position to the folded position, a user may push the block member 332 to convert the lock subunit 33 from the lock state to the unlock state for allowing the relative sliding movement between the inner and outer tubes 321, 322, and move the legs 21 inwardly (in directions indicated by arrows (A) in FIG. 6) to the folded position, where angles between each of the legs 21 and the top plate 1 are at an acute angle. While the legs 21 move from the unfolded position to the folded position, the inner and outer tubes 321, 322 slide relative to each other and the length of the first telescopic subunit 32 is shortened.

Referring to FIGS. 6 and 7, the legs 21 are substantially perpendicular to the top plate 1 for cooperatively supporting the top plate 1 when the legs 21 are in the unfolded position, while the legs 21 are substantially parallel to the top plate 1 when the legs 21 are in the folded position. To operate the legs 21 from the folded position to the unfolded position, a user may move the legs 21 outwardly (in directions opposite to the directions indicated by the arrows (A) in FIG. 6) until the first telescopic subunit 32 is lengthened to have the maximum length (L) and the block member 332 is in the lock state.

In this embodiment, for each leg unit 2, since the two legs 21 are interconnected by the connecting part 22, the two legs 21 are co-movable when the user operates any one of the two legs 21 while the lock subunit 33 is in the lock state.

It is noted that, in other embodiments, the fixture member 42 can be omitted so that the auxiliary plate 41 is removably disposed on the first and second telescopic subunits 32, 34.

Figure 8:
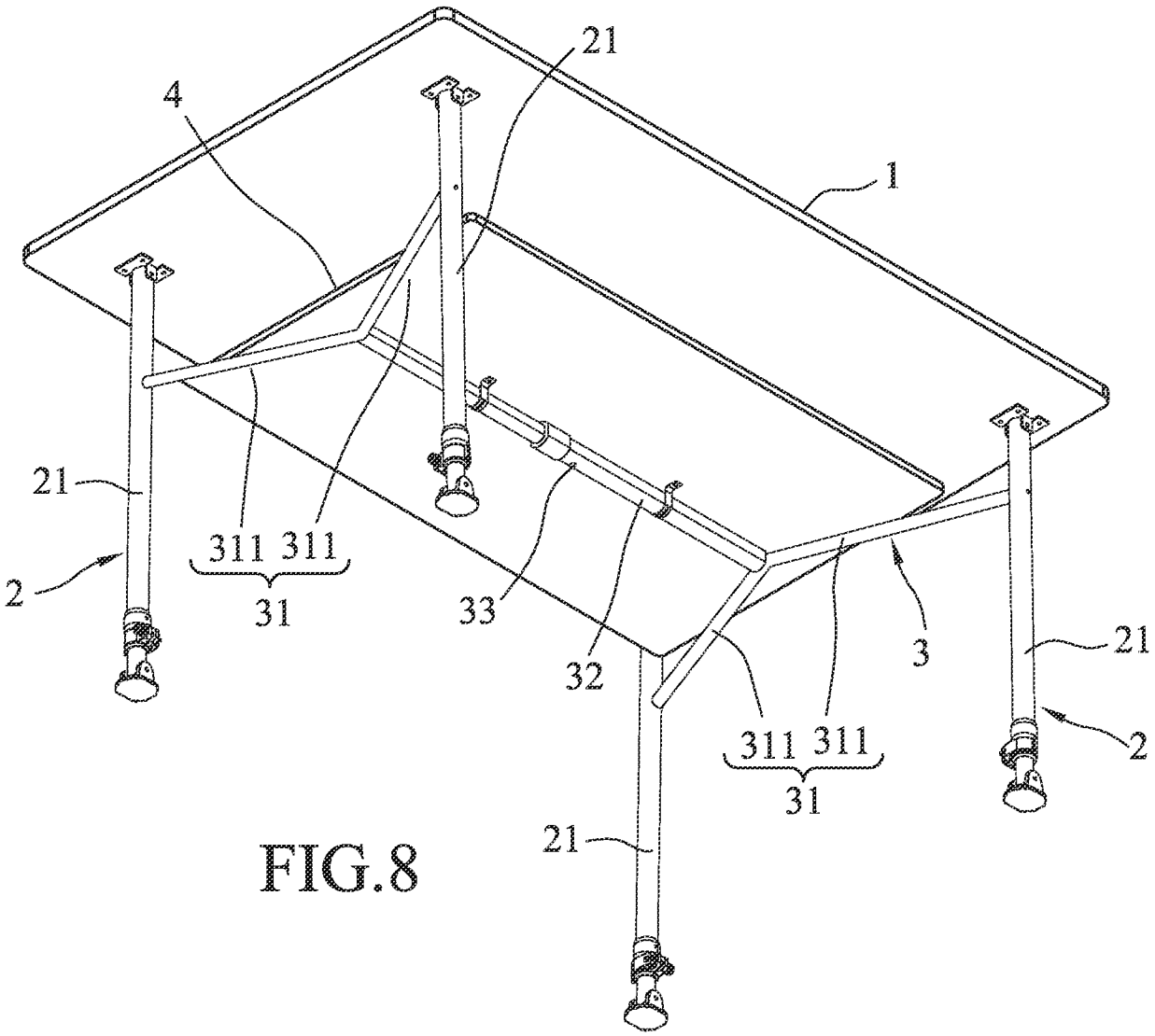
FIG. 8 is a perspective view illustrating a foldable table according to a second embodiment of the disclosure.

FIG. 8 illustrates a foldable table according to a second embodiment of the disclosure, which has a structure generally similar to that of the first embodiment. However, in this embodiment, the configurations of the leg unit 2 and the telescopic support unit 3 are modified.

In this embodiment, each leg unit 2 does not include the connecting part 22 and the bracket member 23 which are illustrated in the previous embodiment (see FIG. 2), and the legs 21 of each leg unit 2 are directly connected to the top plate 1 and are pivotable relative to the top plate 1 between the unfolded position and the folded position. The telescopic support unit 3 does not include the second telescopic subunits 34 which are illustrated in the previous embodiment (see FIG. 2). Each support member 31 of the telescopic support unit 3 includes two support rods 311 that are connected to each other with a predetermined angle, such that the support member 31 is an inverted V-shaped. The support members 31 and the first telescopic subunit 32 cooperatively support the auxiliary plate 41. The two support rods 311 of each support member 31 are further rotatably and respectively connected to the legs 21 of the corresponding leg unit 2, such that the legs 21 of each leg unit 2 are interconnected by the corresponding support member 31.

In this embodiment, for each leg unit 2, since the two legs 21 are interconnected by the corresponding support member 31, the two legs 21 are co-movable when the user operates any one of the two legs 21 while the lock subunit 33 is in the lock state.

Figure 9:
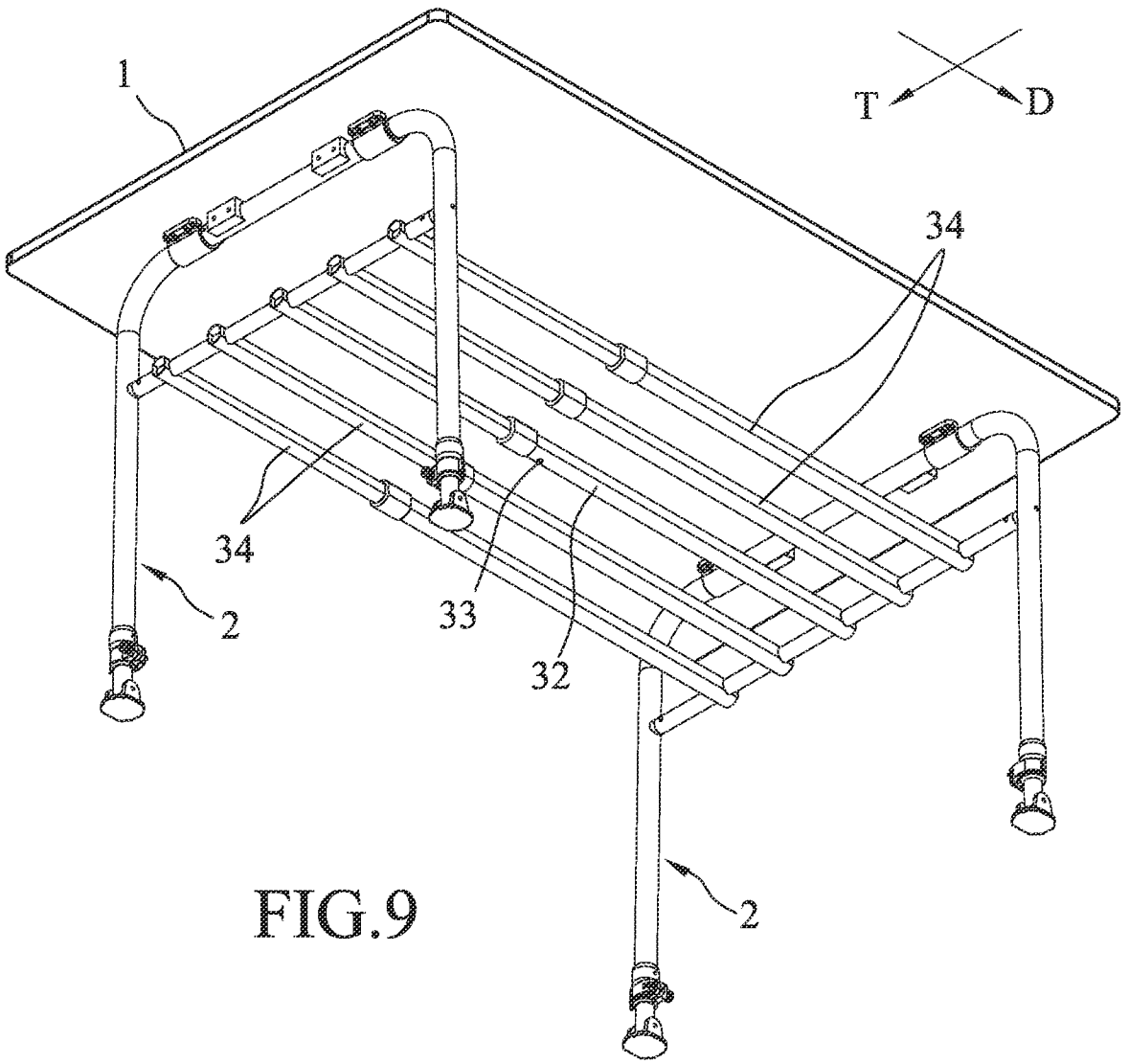
FIG. 9 is a perspective view illustrating a foldable table according to a third embodiment of the disclosure.

FIG. 9 illustrates a foldable table according to a third embodiment of the disclosure, which has a structure generally similar to that of the first embodiment. However, in this embodiment, the foldable table does not include the auxiliary plate unit 4 which was illustrated in the first embodiment (see FIG. 1), and the telescopic support unit 3 includes four second telescopic subunits 34 arranged in the transverse direction (T) on both sides of the first telescopic subunit 32. Specifically, two of the second telescopic subunits 34 are disposed at one side of the first telescopic subunit 32, and the other two of the second telescopic subunits 34 are disposed at the other one side of the first telescopic subunit 32. By virtue of such configuration, the user may put things directly onto the first telescopic subunit 32 and the second telescopic subunits 34.

In summary, by virtue of the arrangement of the telescopic support unit 3, the user may easily operate the legs 21 of the leg units 2 between the unfolded position and the folded position. Besides, the foldable table can provide more surface area for putting things on. In the first and second embodiments, the auxiliary plate 41 may not need to be removed from the telescopic support unit 3 when the user operates the legs 21 to the folded position, so that usability and convenience of the foldable table are not affected.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A foldable table comprising:

a top plate;

two leg units spaced apart from each other in a longitudinal direction, each of said leg units including two legs that are connected to said top plate and that are pivotable relative to said top plate between an unfolded position, where free ends of said legs are distal from said top plate, and a folded position, where said free ends of said legs are proximate to said top plate; and a telescopic support unit including two support members that are respectively mounted on said leg units and that are spaced apart from said top plate, each of said support members being connected between said legs of the respective one of said leg units, a first telescopic subunit that is directly connected between said support members, and that has an inner tube having an inner space that extends in said longitudinal direction, and an outer tube sleeved on and slidable along said inner tube, and a lock subunit that is mounted in said inner space of said inner tube, and that is operable between a lock state, where said lock subunit extends through said inner tube and said outer tube in a radial direction which is perpendicular to said longitudinal direction, so that said legs are maintained in the unfolded position, and that relative sliding movement between said inner tube and said outer tube is not allowed, and an unlock state, where said lock subunit is entirely retracted into said inner space to thereby allow relative sliding movement between said inner tube and said outer tube.

2. The foldable table as claimed in claim 1, wherein:

said inner tube of said first telescopic subunit has a first through hole that extends in the radial direction and that spatially communicates with said inner space;

said outer tube has a second through hole that extends in the radial direction; and said lock subunit retractably extends through said first and second through holes when said lock subunit is in said lock state.

3. The foldable table as claimed in claim 2, wherein said lock subunit of said telescopic support unit has a resilient member that is disposed in said inner tube, and a block member that is connected to said resilient member and that extends through said first and second through holes when said lock subunit is in the lock state, said resilient member being disposed for biasing said block member outwardly in the radial direction.

4. The foldable table as claimed in claim 3, wherein said inner tube has an inner surface that defines said inner space, said resilient member of said lock subunit has an end that abuts against said inner surface of said inner tube, and another end that is connected to said block member.

5. The foldable table as claimed in claim 4, wherein said resilient member of said lock subunit is a V-shaped leaf spring.

6. The foldable table as claimed in claim 1, wherein said telescopic support unit further includes a plurality of spaced-apart second telescopic subunits that are arranged in a transverse direction perpendicular to said longitudinal direction and said radial direction, and that are telescopically and respectively connected between said support members.

7. The foldable table as claimed in claim 6, wherein each of said second telescopic subunits has:

an inner tube member that extends in said longitudinal direction and that is connected to one of said support members; and an outer tube member that is connected to the other one of said support members, and that is sleeved on and slidable along said inner tube member.

8. The foldable table as claimed in claim 7, further comprising an auxiliary plate unit that includes an auxiliary plate supported by said first and second telescopic subunits, and at least one fixture member fixed to a bottom surface of said auxiliary plate and cooperating with said auxiliary plate to surround said first telescopic subunit.

9. The foldable table as claimed in claim 1, wherein each of said leg units further includes a connecting part interconnecting top portions of said legs, and a bracket member fixed to a bottom surface of said top plate and cooperating with said top plate to surround said connecting part.

10. The foldable table as claimed in claim 1, wherein said legs of said leg units are configured to be telescopic for adjusting a height of said foldable table when said legs of said leg units are in the unfolded state.

* * * * *